United States Patent [19]

Saby et al.

[11] 4,427,844

[45] Jan. 24, 1984

[54] METAL-CAPPED ELECTRICAL INSULATOR AND METHOD OF MAKING SAME

[75] Inventors: Charles Saby; Serge Jeannin; Jean-Paul Perrier, all of Saint-Yorre, France; 38

[73] Assignee: Societe Anonyme dite: CERAVER, Paris, France

[21] Appl. No.: 340,104

[22] Filed: Jan. 18, 1982

[30] Foreign Application Priority Data

Jan. 30, 1981 [FR] France ..... 81 01808

[51] Int. Cl.[3] ..... H01B 17/38; H01B 19/00; B22D 19/00

[52] U.S. Cl. ..... 174/188; 29/631; 164/10; 164/108; 164/111; 164/112

[58] Field of Search ..... 174/176, 177, 178, 179, 174/182, 186, 188; 29/631; 164/9, 10, 11, 76.1, 98, 100, 108, 110, 111, 112

[56] References Cited

U.S. PATENT DOCUMENTS 3,964,536 6/1976 Willem ..... 164/98

FOREIGN PATENT DOCUMENTS 1253881 1/1961 France ..... 174/182
2272470 12/1975 France ..... 174/182

*Primary Examiner*—Laramie E. Askin
*Attorney, Agent, or Firm*—Kenyon & Kenyon

[57] ABSTRACT

A metal-capped electrical insulator and method of making same by forming a metal cap on an insulator dielectric by directly casting molten metal round a portion of the dielectric to embed it therein. Before casting the metal (16 or 17), a metal washer (1) is placed in contact with the boundary on the insulator at the edge of the portion to be embedded. The washer has a circular groove (2) open on the side through which the molten metal is poured. Before casting, said washer is deformed, by pressing it hard in a metal-casting mould (30) to the dielectric and deflecting the walls (3, 4) of the groove (2) to create an undercut in the metal washer.

5 Claims, 6 Drawing Figures

METAL-CAPPED ELECTRICAL INSULATOR AND METHOD OF MAKING SAME

The present invention relates to a method of forming a metal cap on an insulator dielectric by casting metal in the molten state over a head portion of the insulator dielectric, and to a metal-capped electrical insulator obtained by the method.

The dielectric in question can be made of glass, which may be hardened glass, of china, of a ceramic substance or of an organic compound.

The cap can be made of aluminum alloy or of zinc alloy sold under the trademark "Zamac."

BACKGROUND OF THE INVENTION

French Pat. No. 1 253 881 discloses a washer of refractory fibre to be placed on the cold portion of the insulator adjacent the portion which is actually embedded and which becomes hot during casting. The washer is intended to reduce the thermal shock during casting.

Also, in the case of a cap-and-rod insulator made of hardened glass, it is known via French patent No. 2 209 987 to fit a metal ring on the head of the dielectric which ring can act as a seal between the mould of the cap and the skirt of the dielectric. Said ring is advantageously made of the same substance as the cap.

The appearance of cracks between the body of the cap and the above-mentioned ring have been observed. These cracks are ugly and, more particularly, dangerous, since they promote corrosion.

Preferred implementations of the present invention mitigate these disadvantages.

SUMMARY OF THE INVENTION

The present invention provides a method of forming a metal cap on an insulator dielectric by directly casting molten metal round a portion of the dielectric to embed the dielectric in the metal, said method comprising the steps of: preparing a metal washer having an axially directed open groove; placing said metal washer on the insulator in such a position as to form a boundary between the portion of the insulator which is to be embedded and the portion which is not to be embedded, said washer being placed with its axially directed groove open towards the side of the boundary which will receive the molten metal; applying pressure to said washer so as to deform it, firstly so that its surfaces which are in contact with the insulator match the profile of the insulator and secondly so that the outer walls of said circular groove are deflected from being axial to provide an undercut in the metalcasting mould, and casting molten metal over the insulator up to said ring.

Preferably the washer and the cap are made of the same metal selected from among aluminum and its alloys.

The present invention also provides an insulator obtained by the above-described method.

It can be of the glass insulator type provided with a metal cap, the washer being in close contact with the skirt of the glass plate. The insulator in accordance with the invention can also be of the organic compound type, the dielectric being a rod made of agglomerated fibres, at least one of the ends of the rod being fitted with a cap associated with said washer.

BRIEF DESCRIPTION OF THE DRAWINGS

An embodiment of the invention is described by way of example with reference to the accompanying drawings, in which.

MORE DETAILED DESCRIPTION

Figure 1:
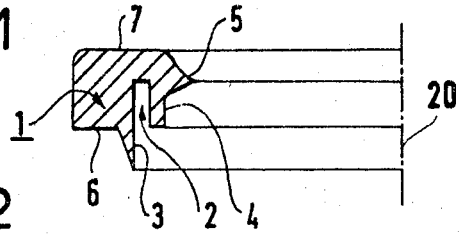
FIG. 1 is a cross section through half of a washer in accordance with the invention.

A washer 1 illustrated in FIG. 1 has an axially-extending circular groove 2 limited by outer and inner walls 3 and 4 respectively which are substantially coaxial about an axis 20. The washer 1 also has an inwardly-extending rib 5, and two opposite axial surfaces 6 and 7 which are substantially planar and orthogonal to the axis 20. The washer is made e.g. of aluminum or aluminum alloy or "Zamak."

Figure 2:
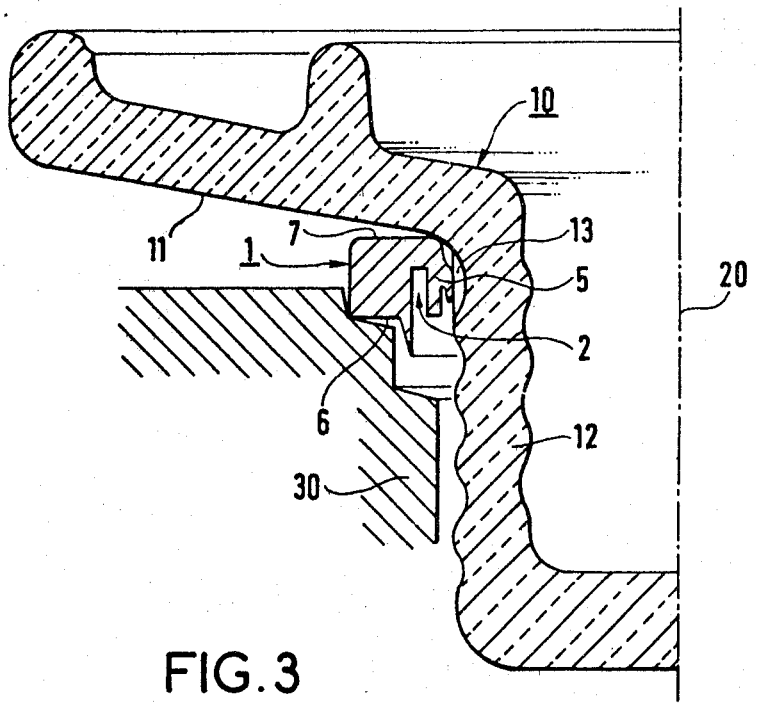
FIG. 2 is a cross section of the half washer in FIG. 1 fitted over a hardened glass dielectric disposed in a mould before injection of metal.

FIG. 2 shows a hardened glass dielectric 10 with a peripheral skirt 11 and a head 12 on which a metal cap is to be cast. The washer 1 is fitted on the head 12 so that the groove 2 is open towards the molten metal side. The rib 5, whose diameter is smaller than that of the head 12, is easily deformed when it is fitted thereon. It is jammed into four lock notches 13 on the head 12 which are disposed at 90° to one another and also serve to center the washer.

The axial surface 7 of the washer engages the outer surface of the skirt 11 of the dielectric, while the other axial surface 6 engages metal-casting means, e.g. a mould 30.

Previous to casting, when the mould 30 closes, pressure is applied axially in the directions of arrows 31 and 32 against the surface 6 of the washer 1 to press it against the dielectric 10 so as to obtain the following result:

The surface 7 of the washer mates with the skirt 11 while the walls 3 and 4 of the circular groove become inclined relative to the axis of symmetry 20. The groove 2 is then undercut relative to the axis 20.

When the molten metal is cast in the direction of arrow 40 round the head 12 of the insulator 10, the metal is anchored in the groove 2, and the wall 3 of the groove bonds to the injected metal.

Figure 4:
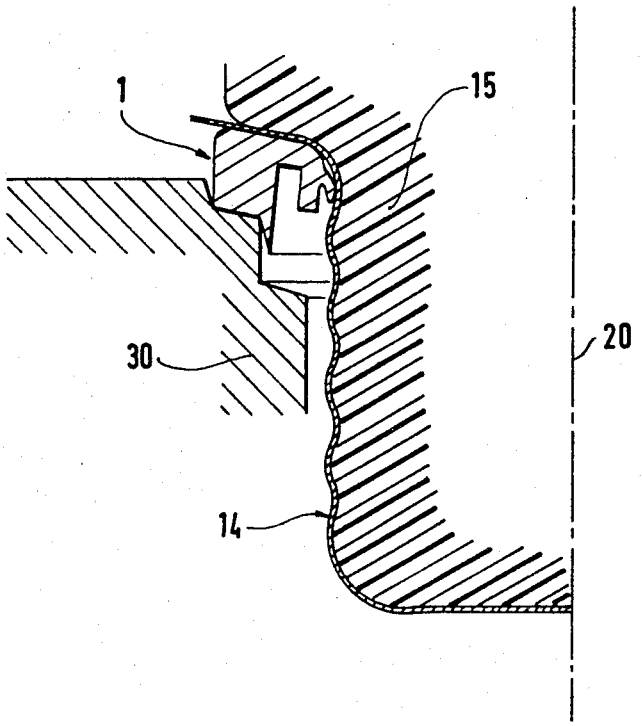
FIG. 4 is a view analogous to that in FIG. 3 except that the hardened glass dielectric is replaced by an organic insulator.

FIG. 4 shows how the method in accordance with the invention is applied to an organic insulator 15 with an agglomerated fibre glass rod whose embedded portion is covered with a crimped metal sleeve 14.

Figure 3:
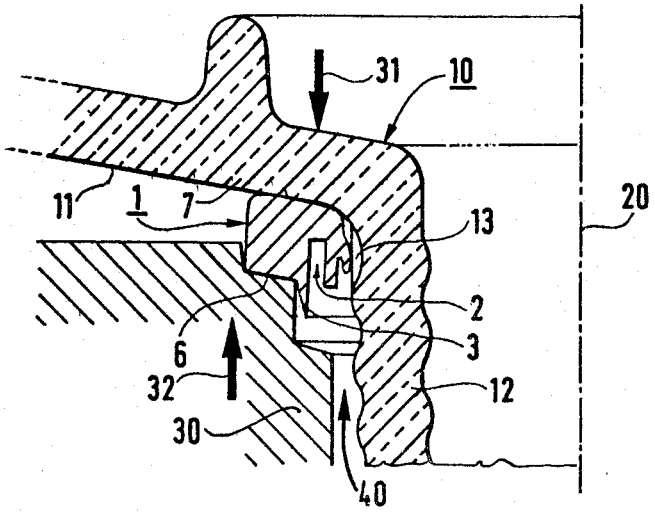
FIG. 3 is analogous to FIG. 2 and illustrates the following step of the method during which step the washer in accordance with the invention is deformed just before the metal is injected.
Figure 5:
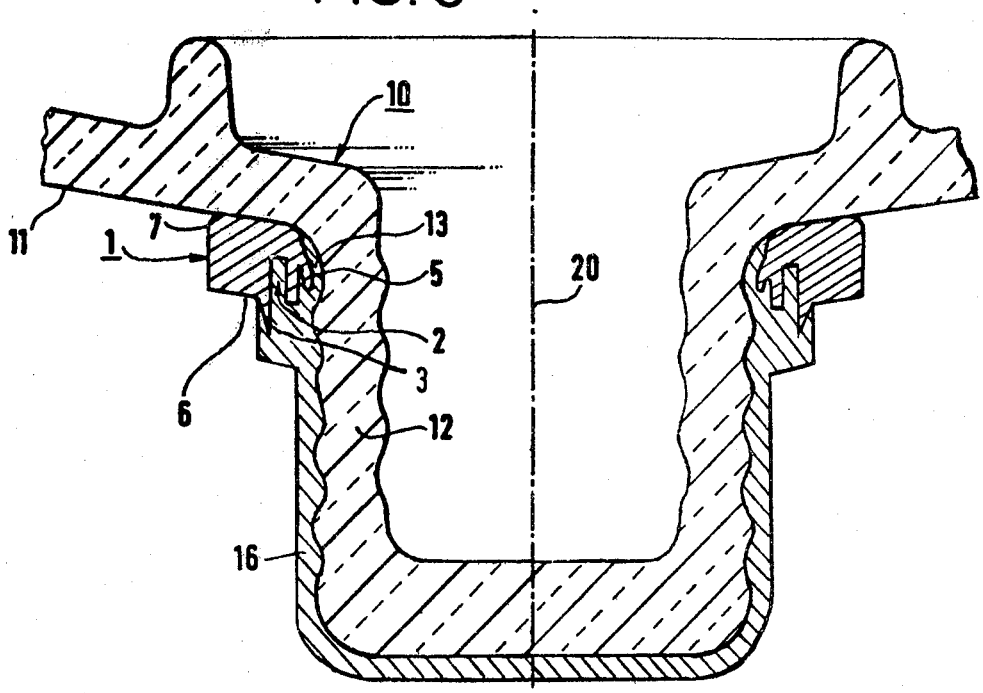
FIG. 5 is a full cross section of a completed cap after injection of metal onto the glass dielectric of FIG. 3.
Figure 6:
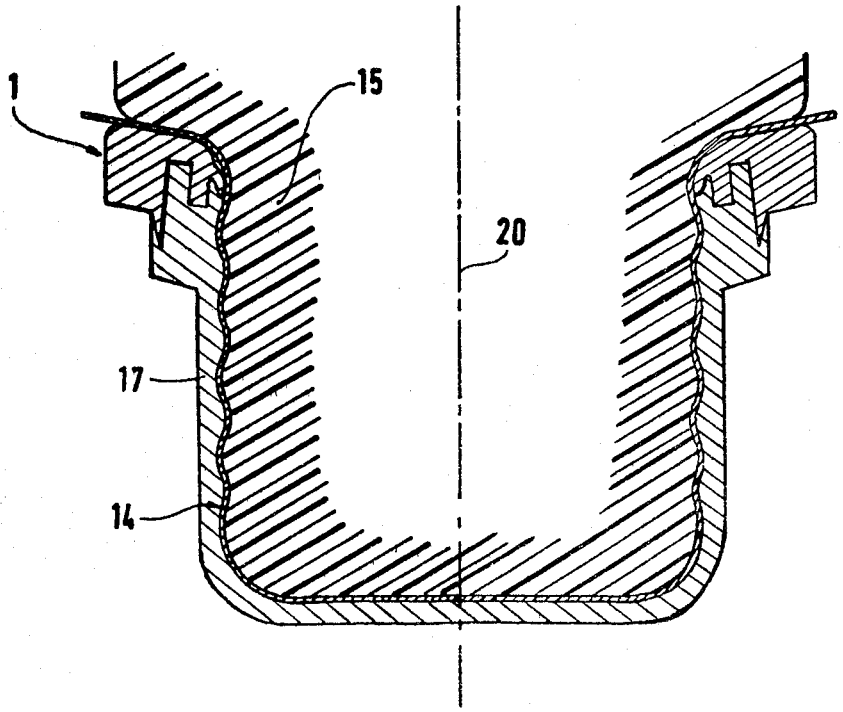
FIG. 6 is a full cross section of a completed cap after injection of metal onto the organic insulator rod of FIG. 4.

FIG. 5 shows a completed insulator after injection of metal into the mould of FIG. 3 to form a cap 16 on the head of the glass dielectric 12. FIG. 6 shows a comparable completed insulator after injection of metal into the mould of FIG. 4 to form a cap 17 over the crimped metal sleeve 14 of the organic insulator 15 of FIG. 4.

The present invention has numerous advantages. The washer used is easy to manufacture by casting since none of its walls is undercut and the shape of the washer allows very efficient bonding to the metal of the sheath. To further increase the bonding, a few studs may be provided in the bottom of the groove 2 of the washer which provide extra means for preventing the washer from rotating relative to the cast metal and for fixing it thereto.

Of course, the invention is not limited to the embodiment which is described and illustrated. It applies to any type of insulating component which has an end that is fitted with an injected metal cap.

We claim:

1. A method of forming a metal cap on an insulator dielectric by directly casting molten metal round a portion of the dielectric to embed the dielectric therein, said method comprising the steps of: forming a metal washer having an axially directed open groove; placing said metal washer on an insulator in such a position as to form a boundary between a portion of the insulator which is to be embedded and a portion which is not to be embedded, said washer being placed against a metal-casting mold with the axially directed groove of the washer open towards the side of the boundary which will receive the molten metal; applying pressure to said washer so as to deform it, firstly so that its surfaces which are in contact with the insulator match the profile of the insulator and secondly so that the side walls of said circular groove are deflected from being axial to provide an undercut in the washer, and casting molten metal into the metal-casting mold over the portion of the insulator to be embedded up to said washer to form a metal cap on said portion to be embedded.

2. A method according to claim 1, wherein the washer and the cap are made of the same metal selected from the group consisting of aluminum and aluminum alloys.

3. A metal-capped electrical insulator comprising:

an insulator dielectric having a head portion and an annular shouldered portion extending outward from the head portion;

a cast metal washer surrounding the head portion of the insulator dielectric, the washer having an annular surface mating with the annular surface of the shouldered portion of the insulator and an axially extending annular groove opening away from the shouldered portion toward the head portion of insulator, the annular groove having straight sides in cross section, one of which is inclined relative to the axis of the washer so as to be undercut; and a cast metal cap embedding the head portion of the insulator dielectric, the metal of the cap extending into the undercut annular groove to interlock the cap with the washer.

4. A metal-capped electrical insulator according to claim 3, wherein said dielectric is a hardened glass, and said washer is pressed closely against the annular shouldered portion.

5. A metal-capped electrical insulator according to claim 3, wherein said insulator dielectric is an organic compound, and the embedded head portion of the insulator has a thin metal sleeve contacting the dielectric and extending under said washer.

* * * * *